US006637774B2

(12) United States Patent
Gaska

(10) Patent No.: US 6,637,774 B2
(45) Date of Patent: Oct. 28, 2003

(54) CLIPBOARD

(75) Inventor: Gilius A. Gaska, Madison, WI (US)

(73) Assignee: Berol Corporation, Freeport, IL (US)

( * ) Notice: Subject to any disclaimer, the term of this patent is extended or adjusted under 35 U.S.C. 154(b) by 0 days.

(21) Appl. No.: 10/078,722

(22) Filed: Feb. 19, 2002

(65) Prior Publication Data

US 2003/0155762 A1 Aug. 21, 2003

(51) Int. Cl.[7] ..... B42D 5/00
(52) U.S. Cl. ..... 281/45
(58) Field of Search ..... D19/88, 78, 91; 281/15.1, 21.1, 29, 37, 44, 45, 51; 248/441.1, 450, 451, 452

(56) References Cited

U.S. PATENT DOCUMENTS

| | | | | |
|---|---|---|---|---|
| 2,850,296 A | | 9/1958 | Ratliff | |
| 3,977,744 A | | 8/1976 | DeWitt | |
| D261,903 S | | 11/1981 | Mulder | |
| 4,496,058 A | | 1/1985 | Harris et al. | |
| 4,892,334 A | | 1/1990 | Sinclair | |
| 4,896,927 A | | 1/1990 | Liu et al. | |
| 4,968,258 A | | 11/1990 | Kees | |
| 5,174,607 A | | 12/1992 | Hill | |
| 5,324,076 A | | 6/1994 | Nieradka | |
| 5,413,382 A | * | 5/1995 | Cornell et al. | 281/45 |
| D379,477 S | | 5/1997 | Shamoon | |
| 5,758,902 A | | 6/1998 | McManus | |
| D428,927 S | | 8/2000 | Chang | |
| D459,397 S | * | 6/2002 | Zeller et al. | D19/88 |

OTHER PUBLICATIONS

Saunders inventory from office 1000.com, www.office1000, com, 2 pages, printed Jun. 22, 2001.

* cited by examiner

*Primary Examiner*—Willmon Fridie, Jr.
(74) *Attorney, Agent, or Firm*—Marshall, Gerstein & Borun LLP

(57) ABSTRACT

A clipboard includes a first support surface, a retainer adjacent the first support surface, a first receptacle coupled to the first support surface, and a lid. The retainer is configured to hold objects adjacent to the first support surface. The first receptacle has a first opening. The lid is movable between a closed position in which the first opening is covered and an open position in which the first opening is uncovered. The lid is configured to move between the closed position and the open position while the support surface remains stationary.

38 Claims, 9 Drawing Sheets

10

30
12
19
16
24
70
66
28
86
90
14
72
20
32
36
22
18
104
71

CLIPBOARD

FIELD OF THE INVENTION

The present invention relates clipboards. In particular, the present invention relates to clipboards including receptacles for containing and storing items.

BACKGROUND OF THE INVENTION

Clipboards are utilized in a variety of different environments where a portable writing surface may be required. To this end, conventionally known basic clipboards generally consist of a flat panel or board and a clip mounted to one end of the board. The clip retains the papers or other documents being written upon against the writing surface provided by the board.

In many circumstances, the user of the clipboard will also require a supply of writing utensils and a supply of paper, forms or other documents. Unfortunately, the clamps or clips cannot clamp enough paper and are not well suited for holding writing utensils. As a result, there is a continuing need for a clipboard that additionally stores and contains writing utensils and paper in an efficient and easily accessible manner.

Prior attempts to solve this problem have been met with limited success. Many advanced clipboards are now provided with a compartment to which the writing board is hinged at its upper end or along its side. Examples of such clipboards are provided in U.S. Pat. Nos. 4,896,927 and D261,903. Alternatively, other advanced clipboards include a concealed sliding drawer for storing documents and writing utensils. U.S. Pat. No. 5,324,076 describes such a clipboard.

While representing an improvement over conventional basic clipboards, such advanced clipboards are still difficult to use. For example, with advanced clipboards including a writing board hinged to an underlying compartment, accessing any item within the compartment requires that the writing board be pivoted out of the way. Consequently, any paper or other item resting upon the writing board must be removed or secured in place each and every time the user wishes to access any item within the underlying compartment. Moreover, lifting or pivoting the writing surface to access the contents of the underlying compartment requires that the user's work be substantially interrupted. With clipboards including sliding storage drawers, extension of the drawer substantially increases the length of the overall clipboard, requiring an enormous amount of space and once again substantially interrupting the user's concentration on his or her work.

SUMMARY OF THE INVENTION

According to one embodiment of the present invention, a clipboard includes a first support surface, a retainer adjacent the first support surface, a first receptacle coupled to the first support surface, and a lid. The retainer is configured to hold objects adjacent to the first support surface. The first receptacle has a first opening. The lid is movable between a closed position in which the first opening is covered and an open position in which the first opening is uncovered. The lid is configured to move between the closed position and the open position while the support surface remains stationary.

According to another embodiment, a clipboard has a major dimension terminating at first and second ends and a minor dimension terminating at first and second sides. The clipboard includes a first support surface, a retainer adjacent the first support surface, and a first receptacle. The retainer is configured to hold objects adjacent to the first support surface. The first receptacle is pivotally supported for pivotal movement about a first pivot axis extending intermediate at least one of the first and second sides and the first and second ends.

According to yet another embodiment, a clipboard includes a first receptacle having a first opening, a second receptacle beside the first receptacle having a second opening, a first cover proximate the first receptacle, and a second cover proximate the second receptacle. At least one of the first cover and the second cover includes a substantially planar support surface. At least one of the first cover and the second receptacle are configured to move relative to one another between a first opening covered position and a first opening closed position. At least one of the second cover and the second receptacle are configured to move relative to one another between a second opening covered position and a second opening closed position.

DETAILED DESCRIPTION OF THE PREFERRED EMBODIMENTS

CLIPBOARD 10

Figure 1:
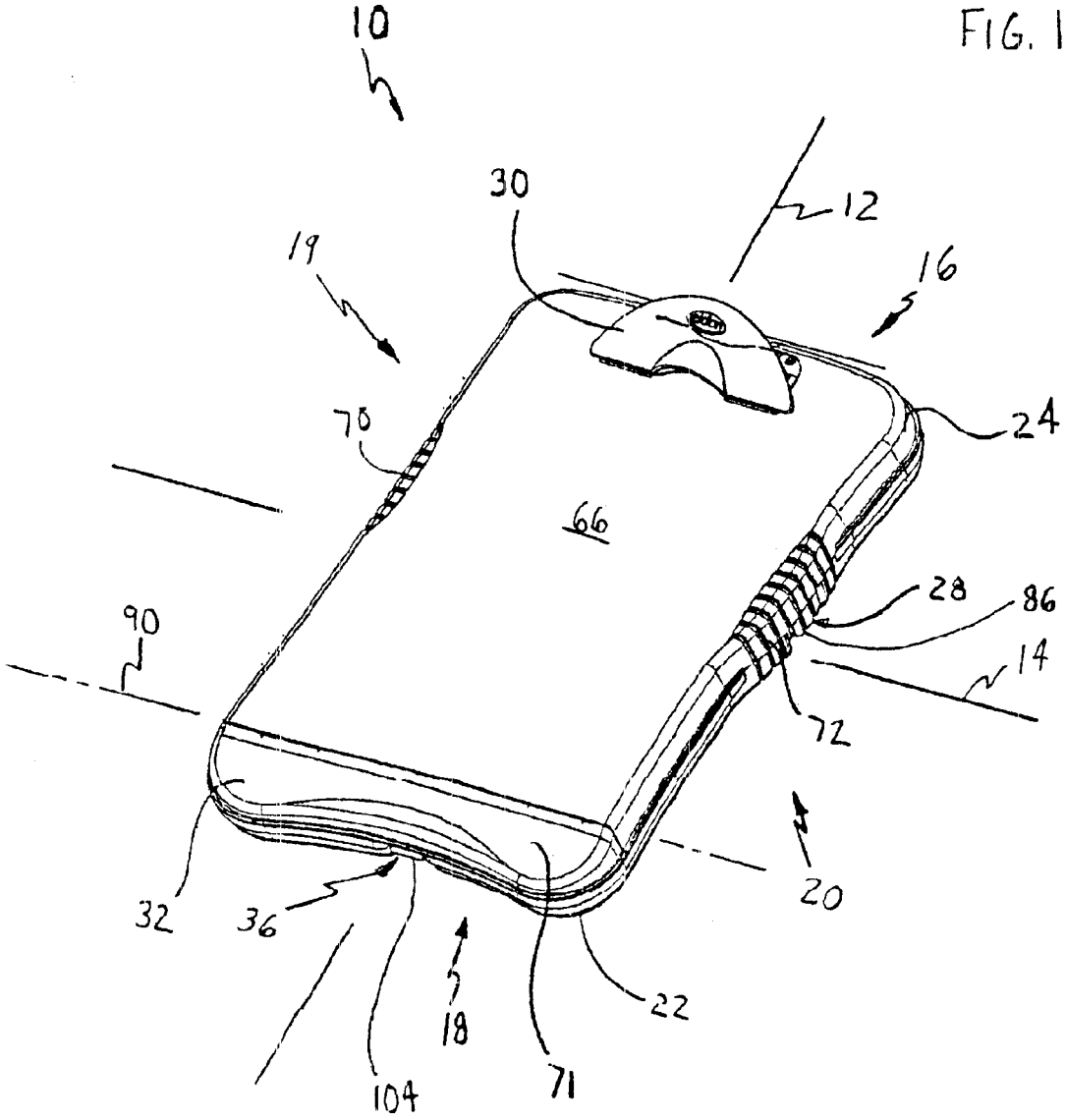
FIG. 1 is a top perspective view of one embodiment of a clipboard incorporating features of the present invention.
Figure 2:
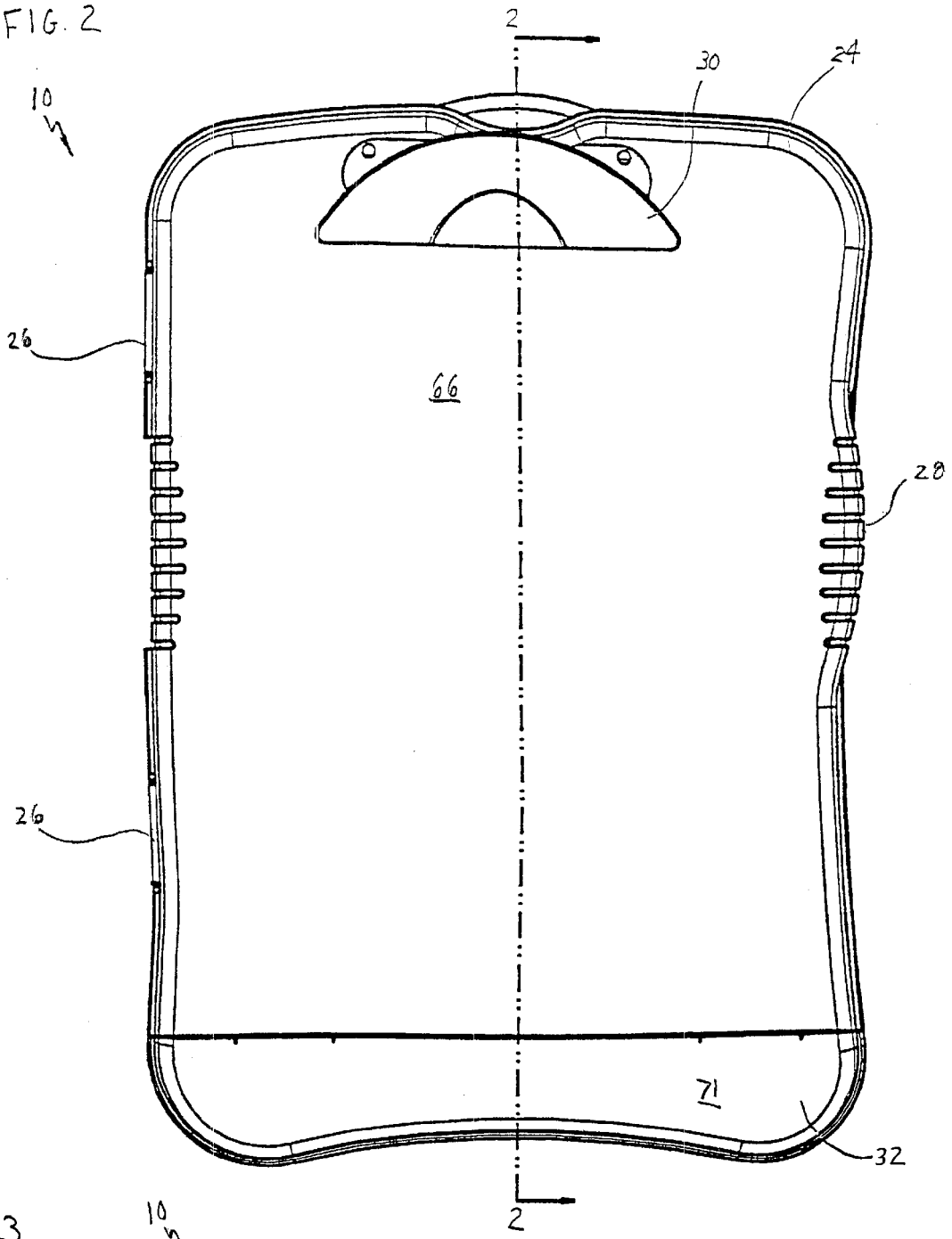
FIG. 2 is a top plan view of the clipboard of FIG. 1.
Figure 3:
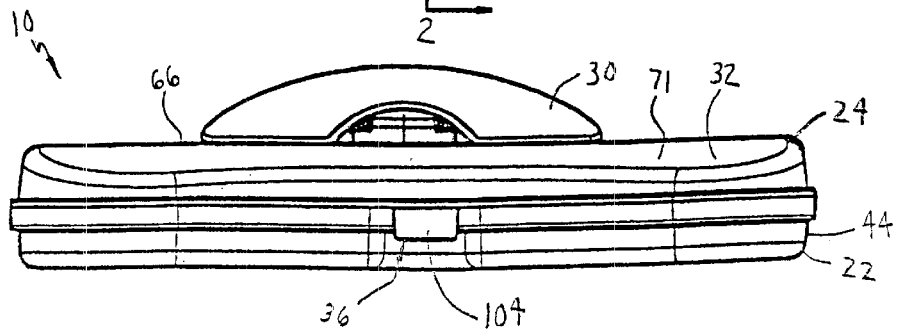
FIG. 3 is a front end elevational view of the clipboard of FIG. 1.
Figure 4:
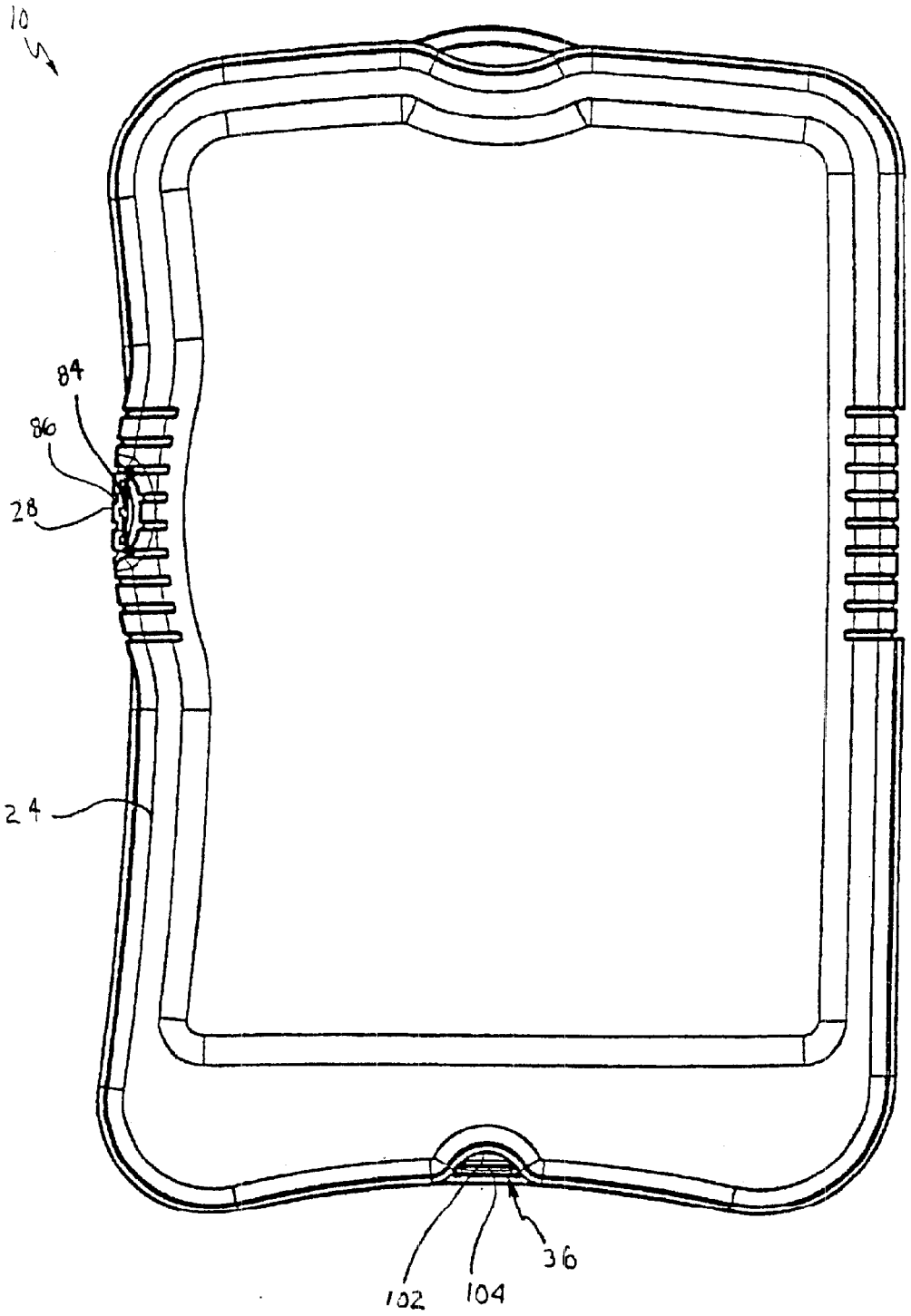
FIG. 4 is a bottom plan view of the clipboard of FIG. 1.
Figure 5:
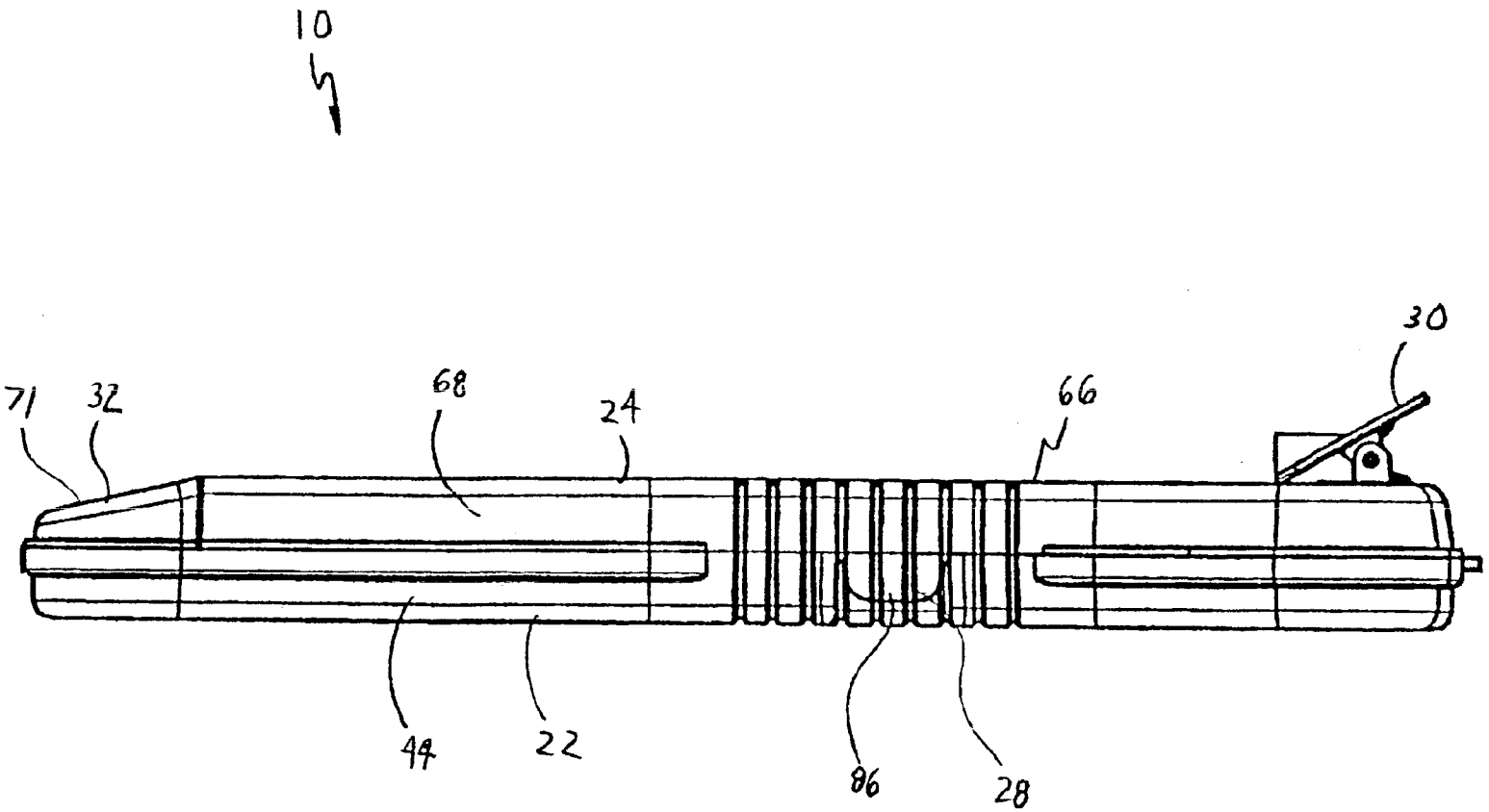
FIG. 5 is a right side elevational view of the clipboard of FIG. 1.
Figure 6:
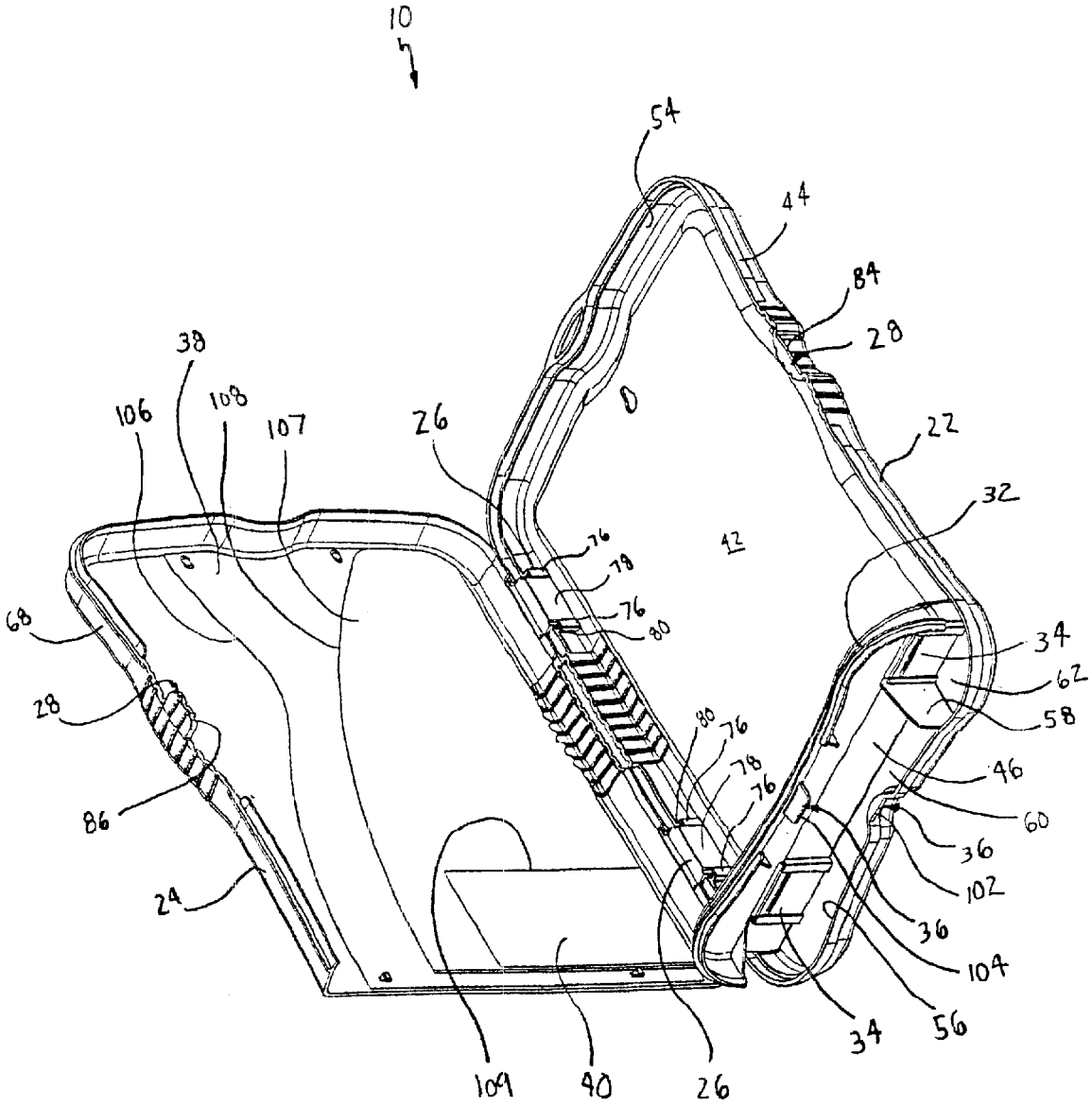
FIG. 6 is a top perspective view of the clipboard of FIG. 1 with a top member and a lid of the clipboard in opened positions.
Figure 7:
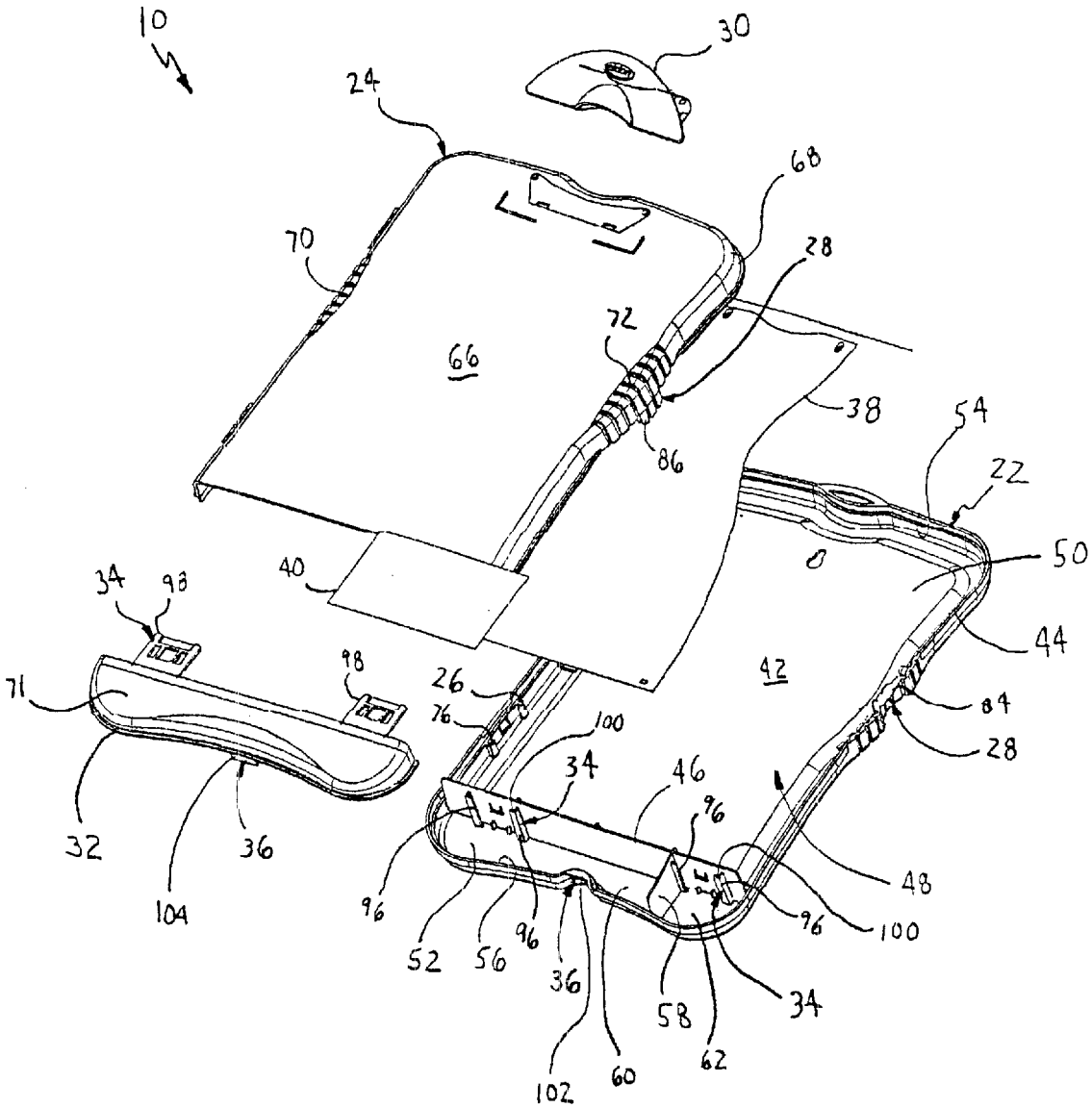
FIG. 7 is an exploded perspective view of the clipboard of FIG. 1.

FIGS. 1–10 illustrate clipboard 10. FIGS. 1–5 illustrate clipboard 10 in a fully closed state, while FIG. 6 illustrates clipboard 10 in a fully opened state. FIG. 7 is an exploded perspective view of clipboard 10. As best shown by FIG. 1, clipboard 10 has a major longitudinal dimension along which axis 12 extends and a minor transverse dimension along which axis 14 extends. In the particular embodiment illustrated, clipboard 10 is generally rectangular in shape, having longitudinal ends 16, 18 and transverse sides 19 and 20. As best shown by FIGS. 1–7, clipboard 10 generally includes bottom member 22, top member 24, hinge mechanism 26, latch mechanism 28, retainer 30, lid 32, hinge mechanism 34, latch mechanism 36, and optional inserts 38, 40 (inserts 38 and 40 shown in FIG. 8 for purposes of illustration). Bottom member 22 forms the base of clipboard 10. Bottom member 22 preferably has a generally clam-shaped configuration and generally includes floor 42, side wall 44, and partition wall 46. Side wall 44 extends upwardly from floor 22 about a perimeter of floor 42 to form a general basin 48. Basin 48 has a depth of approximately 0.75 inches. This depth enables basin 48 to retain an appropriate number of documents, sheets, or storage supplies. Partition wall 46 extends upwardly from floor 42 to divide basin 48 into a main compartment or receptacle 50 and an auxiliary compartment or receptacle 52 (shown in FIGS. 6 and 7).

Receptacle 50 extends beside receptacle 52 and has an opening 54 facing in an upward direction towards top member 24. Receptacle 52 has internal dimensions sized such that receptacle 54 may receive conventionally sized flat unfolded paper documents such as 8 ½"×11" sheets. Receptacle 54 preferably has internal dimensions sized such that receptacle 50 may also receive and store conventionally known A4 paper without the individual sheets needing to be folded. At the same time, however, receptacle 50 has internal dimensions which are sized so as to not require bottom member 22 to be excessively large, bulky or burdensome to carry or manipulate. Preferably, receptacle 50 has an internal dimension of about 10"×13". Opening 54 preferably has similar dimensions as the internal dimensions of receptacle 50. Although less desirable, opening 54 may alternatively be smaller than the overall size of receptacle 50.

Receptacle 52 is situated beside receptacle 54 on an opposite side of partition wall 46 and includes an opening 56. Like opening 54, opening 56 faces in an upward direction. As shown by FIGS. 6 and 7, receptacle 52 is further subdivided by divider wall 58 which separates receptacle 52 into a plurality of compartments 60, 62. Compartment 60 preferably has internal dimensions sized to enable receptacle 52 to contain various conventionally sized writing utensils such as pencils, pens, markers, and the like. Compartment 62 is sized to receive various other accessories or office items, such as paperclips, binder clips, erasers, and the like. Although receptacle 52 is illustrated as being divided into two compartments, receptacle 52 may alternatively be divided into greater than two compartments or may omit any dividers.

Top member 24 cooperates with bottom member 22 and lid 32 to provide an enclosure. Top 24 further provides support surface 66. Support surface 66 is a generally rigid surface against which objects or articles may be held. Preferably, support surface 66 is additionally, continuous and smooth so as to provide a general writing surface. Support surface 66 preferably has a flat, smooth and continuous surface sufficiently large so as to extend beneath the entirety of an 8½×11 inch piece of paper or document. Alternatively, or in addition, surface 66 is preferably large enough so as to extend beneath substantially an entire sheet or document of A4 size. Although surface 66 is illustrated as being substantially flat across its entirety, surface 66 may alternatively include peripheral ribs or raised portions for engaging or locating documents or papers which are held against surface 66.

Figure 10:
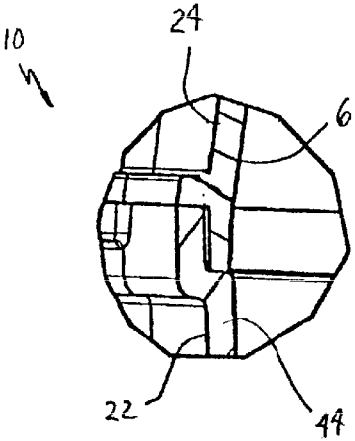
FIG. 10 is an enlarged fragmentary perspective view of the clipboard of FIG. 8 taken along line 10—10.
Figure 8:
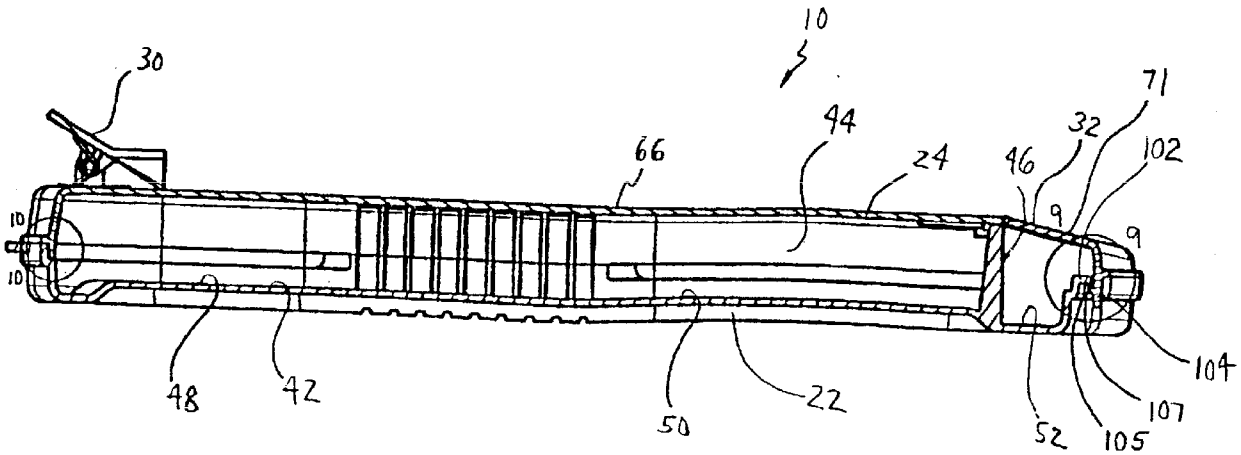
FIG. 8 is a sectional view of the clipboard of FIG. 2 taken along line 2—2.

As further shown by FIGS. 1–7, top member 24 is preferably configured as a clam-shell shaped member having side walls 68 which project downwardly from surface 66 towards bottom member 22. Side walls 68 preferably have a height of approximately 0.75" and are configured to mate (as shown in FIGS. 8 and 10) with side walls 44 of bottom member 22. When clipboard 10 is in a closed state, top member 24 and bottom member 22 form an interior having a height of approximately 1.5", allowing clipboard 22 to contain a substantial number of documents, supplies, or various other accessories such as calculators, electronic organizers and the like. Although less desirable, top member 24 may alternatively comprise a substantially flat planar member or panel, omitting or substantially reducing side walls 68.

In the particular embodiment illustrated, top member 24, as well as bottom member 22, additionally include serrated portions 70, 72. Portions 70 and 72 are integrally formed as part of top member 24 and bottom member 22. Portions 70 and 72 identify the general center of mass of clipboard 10 and facilitate easy gripping of clipboard 10. Portion 72 further identifies the location of latch mechanism 28. Although the particular serrated design shown is aesthetically attractive and provides clipboard 10 with a unique appearance, other designs, surface textures, and configurations may be used in lieu of portions 70 and 72 shown while still providing the same noted functions. For example, in one alternative embodiment, portions 70 and 72 may alternatively be provided with a different color to provide the noted functions or portions 70, 72 may be provided with a different surface texture such as provided by an elastomeric or rubberlike material such as SANTOPRENE sold by Advanced Elastomers.

Hinge mechanism 26 pivotally couples top member 24 to bottom member 22. In the particular embodiment illustrated, hinge mechanism 26 pivotally couples top member 24 to top member 22 along transverse side 19 and along an axis generally parallel to axis 12 (shown in FIG. 1). As a result, top member 24, functioning as a cover for receptacle 50, pivots between an opening covered position in which opening 54 of receptacle 50 is covered and an opening uncovered position in which opening 54 of receptacle 50 is uncovered. Because hinge mechanism 26 extends along the transverse side 19 of clipboard 10, top member 24 pivots between the covered and uncovered position in a fashion similar to that of a book. In alternative embodiments, hinge mechanism 26 may alternatively be located along other sides or portions of clipboard 10. For example, hinge mechanism 26 may alternatively be located along longitudinal end 16 of clipboard 10 such that top member 24 flips upward from the covered position to the uncovered position.

In the particular embodiment illustrated, hinge mechanism 26 provides a living hinge between bottom member 22 and top member 24. The living hinge is formed by ears 76 and tabs 78 (best shown in FIG. 6). Ears 78 are arranged in pairs and extend from side wall 44 of bottom member 22 to form channels 80. Ears 76 are preferably integrally formed as part of a single unitary body with walls 44. Alternatively, ears 76 may be mounted or otherwise affixed to one of side walls 44. Channel 80 may also alternatively be provided by various other structures such that channel 80 is completely bounded.

Tabs 78 comprise flexible flaps extending from side wall 68 along side 19 of top member 24. As shown by FIG. 6, tabs 78 extend into channels 80 and are snapped into place to fixedly secure tabs 78 within channels 80. Tabs 78 are sufficiently flexible so as to form a living hinge, allowing top member 24 to pivot. In the particular embodiment illustrated, tabs 78 are integrally formed as part of a single unitary body with top member 24. Alternatively, tabs 78 may be mounted or otherwise secured to top member 24. This structure enables bottom member 22 and top member 24 to be quickly and easily assembled and pivotally coupled to one another. In alternative embodiments, bottom member 22 and top member 24 may be integrally formed as a single unitary body with hinge mechanism 26. In other alternative embodiments, other conventionally known or future developed structures may be employed for pivotally coupling bottom member 22 to top member 24 such as pivot pins and the like.

Although hinge mechanism 26 is illustrated as having channels 80 formed as part of bottom member 22 and as having tabs 78 formed as part of top member 24, this relationship may be reversed. Furthermore, although hinge mechanism 26 is illustrated as including two spaced individual living hinges, hinge mechanism 26 may alternatively comprise a greater or fewer number of such individual living hinges or may comprise a single elongate living hinge or other hinge mechanism.

Latch mechanism 28 releasably retains top member 24 and bottom member 22 in at least one of the covered position and the uncovered position. In the particular embodiment illustrated, latch mechanism 28 releasably retains top member 24 in the covered position. In the particular embodiments illustrated, latch mechanism 28 extends along transverse side 20 of clipboard 10 opposite hinge mechanism 26. Alternatively, latch mechanism 28 may be located on other portions of clipboard 10.

Latch mechanism 28 preferably includes overhang 84 and catch 86. Overhang 84 provides a rib or ridge forming a channel or detent configured to releasably receive a portion of catch 86. Overhang 84 is preferably integrally formed as part of a single unitary body with bottom member 22 along side wall 44. Alternatively, overhang 84 may be mounted or otherwise secured to bottom member 22 at various alternative locations of bottom member 22.

Catch 86 extends from top member 24 and includes a hook or other projection configured to releasably engage overhang 84 to secure and retain top member 24 relative to bottom member 22 in the covered position. In the particular embodiment illustrated, catch 86 flexes during engagement and disengagement with overhang 84. In the particular embodiment illustrated, catch 86 is integrally formed as part of a single unitary body with the remainder of top member 24 along side 20. Alternatively, catch 86 may be mounted to top member 24 and may be formed with or coupled to top member 24 along other portions of top member 24 so long as catch 86 engages overhang 84. Although latch mechanism 28 is described as including overhang 84 and catch 86, various other mechanisms may be employed for releasably retaining top member 24 relative to bottom member 22. Examples of alternative latch mechanisms include zippers, buttons, hook and loop fastener arrangements, as well as other conventionally known and future developed retaining structures or mechanisms. Although less desirable, latch mechanism 28 may be omitted.

Retainer 30 extends proximate to support surface 66 of top member 24 and is configured to releasably retain articles adjacent to surface 66. In the particular embodiment illustrated, retainer 30 comprises a conventionally known clip mounted to top member 24 proximate to longitudinal end 16 of clipboard 10. Alternatively, retainer 30 may be integrally formed or as part of or mounted to top member 24 proximate to other portions of support surface 66. Moreover, in lieu of comprising a clip, retainer 30 may comprise other conventionally known or future developed mechanisms configured for releasably retaining an object or article, such as paper and the like, adjacent to support surface 66. For example, depending upon the characteristics of the article to be held against surface 66, retainer 30 may alternatively comprise a magnet, a portion of a hook and loop fastening arrangement, a pressure-sensitive adhesive and the like.

Lid 32 comprises a cover which is movable between a closed position in which opening 56 of receptacle 52 is covered (as shown in FIG. 1) and an open position in which opening 56 of receptacle 52 is uncovered (as shown in FIG. 6). Importantly, lid 32 is configured to move between the closed position and the open position while support surface 66 remains stationary. As a result, the user of clipboard 10 may access the contents of receptacle 52 without having to pivot or otherwise move top member 24 or support surface 66. This is extremely beneficial in circumstances where it is important that the user's attention to the article upon surface 66 not be substantially interrupted or where time is of the essence. For example, a person may be using clipboard 10 to support written documents containing fine print. Whereas moving support surface 66 may cause the person to lose his or her place, clipboard 10 enables the user's place on the document to be maintained as the user accesses the contents of receptacle 52 to, for example, retrieve an alternative pen, highlighter or eraser. Likewise, a person using clipboard 10 may be taking notes or taking a test. Whereas moving support surface 66 would require valuable time, possibly causing notes to be missed or insufficient time for completing the test, clipboard 10 and its lid 32 enable the person to quickly and easily retrieve, for example, a pen, pencil or eraser.

In the particular embodiment illustrated, lid 32 pivots between the closed position and the open position along a pivot axis 90 which extends intermediate ends 16 and 18, proximate to longitudinal end 18. Axis 90 extends parallel to minor axis 14 and perpendicular to major axis 12 of clipboard 10. Axis 90 further extends perpendicular to the pivot axis of top member 24. As a result, as shown by FIG. 6, lid 32 flips up about axis 90 towards retainer 30. Wherein lid 32 is flipped to the open position shown in FIG. 6, lid 32 does not project beyond the overall outer periphery of clipboard 10 (as viewed from the top). As a result, lid 32 may be opened in crowded or tight environments where space is at a premium.

Although lid 32 is illustrated as pivoting between the open position and the closed position along axis 90, lid 32 may alternatively pivot between such positions along alternative axes. For example, clipboard 10 may alternatively be configured such that lid 32 pivots between the closed and open position along an axis parallel to minor axis 14 and situated at longitudinal end 18 or may be configured to pivot about an axis parallel to major axis 12 along a portion of either side 19 or side 20, while receptacle 52 remains as generally shown in FIG. 6. Lid 32 may be configured to pivot about an axis that extends along the major dimension of receptacle 52 or along a minor dimension of receptacle 52 regardless of whether receptacle 52 extends perpendicular or parallel to major axis 12. For example, depending upon the location and size of top member 24, receptacle 50 and receptacle 52, lid 32 may alternatively extend along all or a portion of transverse side 20, wherein lid 32 pivots about an axis parallel to major axis 12.

Hinge mechanism 34 pivotally couples lid 32 to bottom member 22 for pivotal movement about axis 90. In the particular embodiment illustrated, hinge mechanism 34 provides a living hinge and generally includes ears 96 and tabs 98. Like ears 76 discussed previously, ears 96 are generally arranged in pairs and situated opposite to one another so as to form channel 100. Ears 96 are preferably integrally formed as part of a single unitary body with bottom member 22. In the particular embodiment illustrated, ears 96 extend from partition wall 46 or divider wall 58. Alternatively, ears 96 may be mounted to or integrally formed as part of other portions of bottom member 22. Moreover, channel 100 may be provided by other structures so as to be continuously bounded.

As best shown by FIG. 7, tabs 98 are generally the same construction as tabs 78 and extend from lid 32. Tabs 98 snap in place within channels 80 to secure lid 32 to bottom member 22. Tabs 98 are preferably formed from a sufficiently flexible material, such as plastic, to form a living hinge such that lid 32 may pivot between the open and closed positions. This construction enables clipboard 10 to be manufactured at a low cost and to be efficiently assembled. Alternatively, hinge mechanism 34 may comprise other conventionally known or future developed structures or mechanisms for pivotally supporting two structures adjacent to one another. For example, hinge mechanism 34 may comprise a pivot pin or other structure. Although hinge mechanism 34 is illustrated as including a pair of individual living hinge elements formed by ears 96 and tabs 98, hinge mechanisms 34 may include more than two such living hinge elements or a fewer number of such elements. Moreover, although tabs 98 are illustrated as projecting from lid 32, while tabs 96 are formed as part of bottom member 22, this relationship may be reversed.

Figure 9:
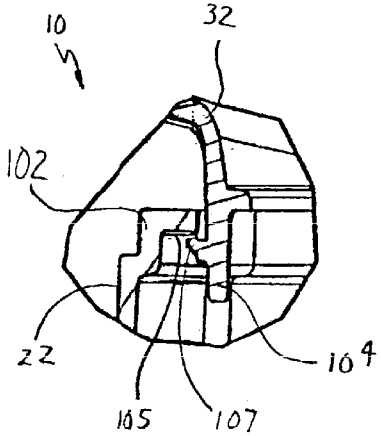
FIG. 9 is an enlarged fragmentary sectional view of the clipboard of FIG. 8 taken along line 9—9.

Latch mechanism 36 is configured to releasably retain lid 32 in at least one of the open and closed positions. In the particular embodiment illustrated, latch mechanism 36 releasably retains lid 32 in the closed position. As best shown by FIGS. 9 and 10, latch mechanism 36 generally includes overhang 102 and catch 104. Overhang 102 is integrally formed as a single unitary body with bottom member 22 and includes a ridge or projection or other structure which forms a recess or detent 105 configured to receive a portion of catch 36. In lieu of being integrally formed as part of body member 22, overhang 102 may be mounted to bottom member 22.

Catch 36 extends from lid 32 and includes a hook or projection 107 configured to project into the recess or detent 105 provided by overhang 102. In the particular embodiment illustrated, catch 104 is integrally formed as part of a single unitary body with lid 32 out of a sufficiently flexible material so as to flex between an overhang engaging position (shown in FIG. 9) and an overhang disengaged position. Although catch 104 is illustrated as being integrally formed as part of lid 32, catch 104 may alternatively be mounted or otherwise secured to lid 32. Moreover, although catch 104 is illustrated as being formed as part of lid 32, while overhang 102 is formed as part of bottom member 22, this relationship may be reversed. Furthermore, other conventionally known or future developed latch mechanisms which releasably retain two members relative to one another may be used in lieu of the illustrated latch mechanism 36.

Inserts 38 and 40 are optional in nature and additionally provide clipboard 10 with interior folders or pockets for storing and organizing documents and cards. As best shown by FIG. 6, insert 38 is preferably mounted to top member 24 on a side of top member 24 opposite support surface 66. Insert 38 is secured to top member 24 at points at least along the periphery of insert 38 so as to form a pocket 106 which is carried by top member 24. As further shown by FIG. 6, insert 38 additionally includes a secondary flap 107 which provides a second pocket 108. Insert 40 is affixed to the exterior of flap 107 along selected portions so as to provide yet an additional pocket 109 for storing business cards and other smaller documents.

Overall, FIGS. 1–10 illustrate a clipboard 10 that not only provides a support surface for supporting held documents for being reviewed or written upon, but also provides independently accessible main and auxiliary compartments or receptacles 50 and 52. Because auxiliary compartment or receptacle 52 may be accessed independent of receptacle 50 without requiring the repositioning of support surface 66, the contents of compartment 52 may be retrieved or inspected without substantially interrupting the use of the articles retained upon surface 66 and without inconveniencing the user of clipboard 10. Although FIGS. 1–10 illustrate a most preferred embodiment, other embodiments are also contemplated. For example, although support surface 66 and lid 32 are illustrated as pivoting relative to bottom member 22 to open or close the underlying receptacles 50 and 52, one or both of surface 66 (or top member 24) or lid 32 may alternatively move by other means between the opened and closed positions. In one embodiment, one or both of surface 66 or lid 32 may slide relative to the underlying receptacle and portions of bottom member 22 between the opened and closed positions. The sliding movement may be facilitated by tracks or other guiding structures. Such sliding movement may occur in a direction along axis 12 or along axis 14. In another such embodiment, one or both of surface 66 or lid 32 may compress or fold between the closed and opened positions. For example, lid 32 may compress or fold in a fashion similar to that of an accordion relative to the underlying compartment or receptacle 52 to permit access to compartment 52 and unfold or uncompress to cover receptacle 52. Likewise, one or both of surfaces 66 or 32 may stretch from an open position to a closed position. In particular embodiments, such opening and closing means may be combined. For example, although lid 32 may pivot between the open and closed positions, lid 32 may additionally include a door or window which slides to provide limited access to a particular portion of receptacle 52.

Although clipboard 10 is preferably formed from a generally opaque plastic material such as polypropylene, various other materials may be used alone or in combination with another to form clipboard 10. Such materials may include poyethylene, or a plastic of the olefin family that allows "living hinge" capabilities. In yet additional alternative embodiments, at least portions of support surface 66 or lid 32 may be formed from translucent or even transparent material so as to permit the underlying contents of clipboard 10 to be inspected.

Although lid 32 is illustrated as having an upper or outer surface 71 which extends into plane oblique relative to surface 66 to provide clipboard 10 with a sleek aesthetically attractive appearance, surface 71 may alternatively extend in a plane contiguous with the plane in which surface 66 extends such that surface 71 provides a second support surface, increasing the total overall surface area of clipboard 10 against which articles may be retained while being inspected or written upon.

CLIPBOARD 110

Figure 11:
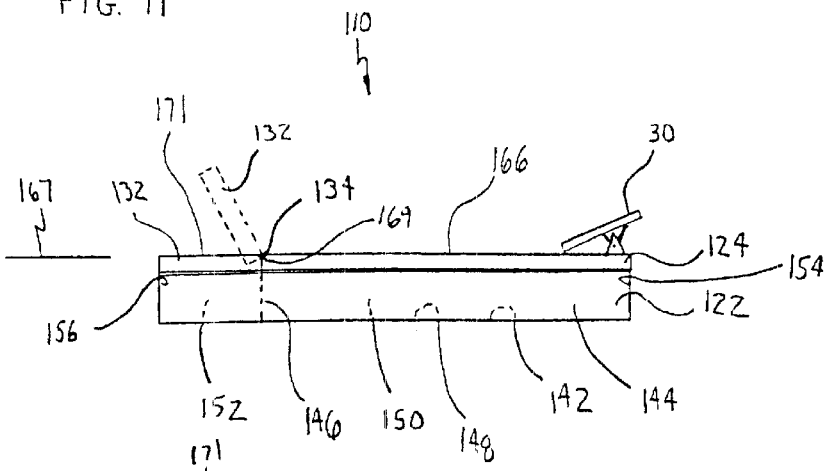
FIG. 11 is a side elevational view schematically illustrating a first alternative embodiment of the clipboard of FIG. 1.

FIGS. 11–17 schematically illustrate alternative embodiments of clipboard 10 shown in FIGS. 1–10. FIG. 11 schematically illustrates clipboard 110, a first alternative embodiment of clipboard 10. In particular, FIG. 11 is a side elevational view of clipboard 110 which is a generally rectangular shape (when viewed from the top) similar to clipboard 10. Clipboard 110 generally includes bottom member 122, top member 124, hinge mechanism 26 (shown and described with respect to clipboard 10), latch mechanism 28 (shown and described with respect to clipboard 10), retainer 30, lid 132, hinge mechanism 134, and latch mechanism 36 (shown and described with respect to clipboard 10). Bottom member 122 is substantially similar to bottom member 22. Bottom member 122 has a floor 142 and walls 144 which form a basin 148. Bottom member 122 further includes an internal partition wall 146 which divides basin 148 into a main compartment 150 and an auxiliary compartment 152.

Top member 124 preferably has a general clam-shaped configuration similar to that of top member 24. Alternatively, top member 124 may be a generally flat planar member. Top member 124 provides a support surface 166 which is a generally flat planar surface upon which articles may be held and possibly written upon. Surface 166 preferably extends in a plane 167. Surface 166 is preferably dimensioned so as to be at least 8 ½×11 inches and preferably further dimensioned so as to be capable of extending entirely beneath conventional A-4 size paper. The underlying receptacle 150 is similarly dimensioned. Similar to top member 24, top member 124 preferably pivots about an axis along its longitudinal transverse side opposite the latching mechanism 28.

Lid 132 is substantially similar to lid 32 except that lid 132 is pivotally coupled to top member 124 in lieu of bottom member 122. Lid 132 pivots about axis 169 between a closed position (shown in solid) in which lid 132 covers receptacle 152 and an open position (shown in broken lines) in which opening 156 is uncovered. Like lid 32 of clipboard 10, lid 132 enables the interior of receptacle 152 and its contents to be accessed independently of receptacle 152 and without requiring movement of support surface 166. However, because lid 132 is pivotally coupled to top member 124, lid 132 moves with top member 124 and support surface 166 when the interior of receptacle 150 is being accessed. With clipboard 110, the user has the option of accessing just the interior of receptacle 152 by lifting just lid 132 or the option of accessing the interior of both receptacles 150 and 152 by moving top member 124, preferably by pivoting top member 124 in a fashion similar to the pivoting of top member 24.

In addition to being carried by top member 124, lid 132 further increases the overall upper surface of clipboard 110 for supporting articles. In particular, unlike lid 32, lid 132 has a generally flat planar support surface 171 which also extends in plane 167 when lid 132 is in the closed position. As a result, surfaces 166 and 171 cooperate to provide an enlarged overall support area. Although less desirable, lid 132 may alternatively be configured so as to have a top surface which extends oblique to surface 166 in a fashion similar to lid 32 of clipboard 10.

Hinge mechanism 134 pivotally couples lid 132 to top member 124. Hinge mechanism 134 preferably comprises a living hinge. In one particular embodiment, hinge mechanism 134 comprises a flap of a flexible material, such as plastic, preferably formed as part of a unitary body with both top member 124 and lid 132. Alternatively, hinge mechanism 134 may be provided by inter-engaging channels and tabs such as described with respect to clipboard 10. In yet in other embodiments, hinge mechanism 134 may comprise other conventionally known or future developed mechanisms or structures configured for pivotally supporting two elements relative to one another.

CLIPBOARD 210

Figure 12:
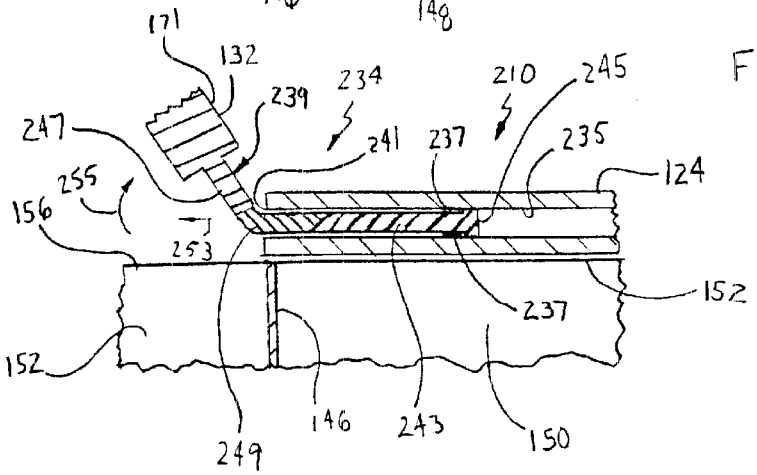
FIG. 12 is an enlarged fragmentary sectional view of a second alternative embodiment of the clipboard of FIG. 1.

FIG. 12 illustrates clipboard 210, a second alternative embodiment of clipboard 10. Clipboard 210 is substantially identical to clipboard 110, except that clipboard 210 includes hinge mechanism 234 in lieu of hinge mechanism 134. For ease of illustration, those remaining components of clipboard 210 which correspond to similar components of clipboard 110 are numbered similarly. Hinge mechanism 234 generally includes channel 235, stop 237, and tail 239. Channel 235 is formed within top member 124 proximate to receptacle 152. Channel 235 has a transversely extending opening 241and is configured to receive tail 239.

Stops 237 project from opposite sides of channel 235 towards one another so as to provide catches or shoulders for limiting the extent to which tail 239 may be withdrawn from channel 235. Although stops 237 are illustrated as a pair of opposite projections, the configuration of stops 237 may be varied depending upon the configuration of channel 235 and the configuration of tail 239.

Tail 239 comprises one or more straps, bands, or extensions extending from lid 132. Tail 239 is preferably integrally formed as part of a single unitary body with lid 132. Alternatively, tail 239 may comprise several components which are secured or otherwise mounted to one another. Tail 239 generally includes distal portion 243 terminating at distal end 245, proximal portion 247, and intermediate portion 249. Distal portion 243 is preferably rigid so as guide movement of tail 239 between stops 237 and within channel 235. Distal end 245 comprises an enlarged portion configured so as to engage the stop surfaces of stops 237 to limit the withdrawal of tail 239 from channel 235. In one particular embodiment, distal end 245 may be sufficiently flexible to enable its insertion into channel 235 past stops 237 or may include a conventionally known one-way pivot construction to enable partial collapse during insertion.

Proximal portion 247 extends most closely to lid 132 and preferably comprises an elongate transversely extending tab formed of material more rigid than intermediate portion 249. Proximal portion 247 is preferably configured to closely mate with the interior surfaces of channel 135. As a result, when proximal portion 247 is inserted into channel 235, proximal portion 247 rigidly supports lid 132 relative to top member 124 to enhance the use of surface 171of lid 132.

Intermediate portion 249 inter joins proximal portion 247 and distal portion 243. Intermediate portion 249 is preferably formed from a material sufficiently flexible so as to serve as a living hinge for lid 132, permitting lid 132 to pivot in the open and closed positions. In operation, after being unlatched, lid 132 is moved in the direction indicated by arrow. 153 so as to withdraw proximal portion 247 from channel 235. Thereafter, lid 132 is pivoted upwardly in the direction indicated by arrow 255 to the open position. Complete removal of tail 239 from channel 235 is prevented by distal end 245 engaging stops 237. Closing of lid 132 is achieved by performing the same steps in opposite directions and in reverse fashion.

CLIPBOARD 310

Figure 13:
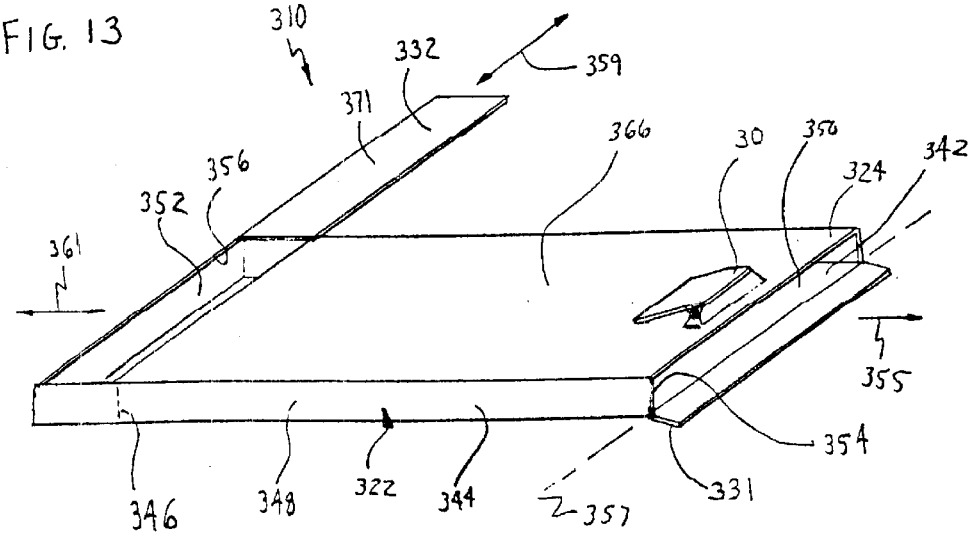
FIG. 13 is a top perspective view of a third alternative embodiment of the clipboard of FIG. 1.

FIG. 13 illustrates clipboard 310, a third alternative embodiment of clipboard 10. Clipboard 310 generally includes bottom member 322, top member 324, retainer 30, door 331, and lid 332. Bottom 322 generally includes a floor 342 and a multitude of side walls 344 which form a basin 348. Bottom member 322 further includes a partition wall 346 which divides basin 348 into a main receptacle 350 and an auxiliary receptacle 352. Main receptacle 350 omits one of walls 344 and includes an axial opening 354 facing in the direction indicated by arrow 355. Receptacle 352 has an opening 356 facing in an upward direction perpendicular to the longitudinal direction in which opening 354 faces. Receptacle 350 preferably has internal dimensions configured so as to completely receive, without folding or other alteration, 8½×11 inch documents. Receptacle 350 is also preferably configured so as to entirely receive, without folding or other alteration, size A-4 paper. At the same time, receptacle 352, like receptacle 152, is sized to receive writing utensils, clips, and other smaller office supplies.

Top member 324 is coupled to bottom member 322 so as to extend over receptacle 350. Top member 324 provides support surface 366. Like support surface 66, support surface 366 provides a relatively smooth, flat rigid area against which articles, such as paper documents, may be held by retainer 30. In the preferred embodiment illustrated, top member 324 is permanently affixed to bottom member 322. Preferably, top member 324 is integrally formed as a single unitary body with bottom member 322. Alternatively, top member 324 may be configured to move relative to bottom member 322 such as being pivotally coupled to bottom member 322 or such as sliding relative to bottom member 322.

Door 331 comprises an elongate closure coupled to at least one of bottom member 322 or top member 324 and configured to move between a closed position in which door 331 covers opening 354 and an open position which permits the contents of receptacle 350 to be accessed or inspected. In the particular embodiment illustrated, door 331 is pivotally coupled to bottom member 322 for pivotal movement about axis 357. In alternative embodiments, door 331 may be pivoted about an axis along top member 324 or along one of side walls 322. In yet other alternative embodiments, door 331 may be slidably captured along opening 354 so as to slide between open and closed positions.

Lid 332 moves between a closed position in which lid 332 covers opening 356 of receptacle 352 and an open position (shown) in which opening 356 of receptacle 352 is uncovered to allow access to the interior of receptacle 352. In the particular embodiment illustrated, lid 332 slides between the closed and open positions in the direction indicated by arrows 359. In alternative embodiments, lid 332 may alternatively slide between the open and closed positions in the directions indicated by arrows 361. Overall, lid 332 enables the interior of receptacle 352 to be accessed independently of receptacle 350 and without requiring movement of support surface 366.

In the particular embodiments illustrated, lid 332 comprises a generally flat panel slidably captured within opposing channels or grooves transversely extending above receptacle 352. With this construction, lid 332 provides a generally flat support surface 371 which extends substantially within the same plane as support surface 366 to enlarge the overall surface area provided by clipboard 310. In alternative embodiments, lid 332 may have various other configurations or structures which slides relative to receptacle 352. In one particular embodiment, portions of top member 324, as well as lid 332, are translucent and preferably transparent to permit the contents within receptacles 350 and 352 to be viewed while door 331 and lid 32 are in the closed positions.

CLIPBOARD 410

Figure 14:
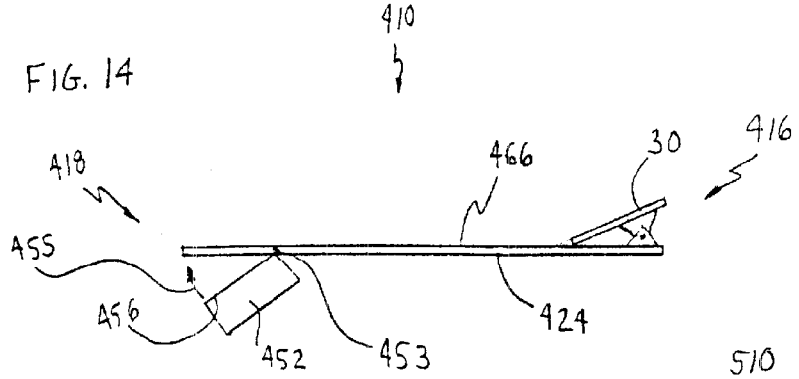
FIG. 14 is a side elevational view of a fourth alternative embodiment of the clipboard of FIG. 1.

FIG. 14 illustrates clipboard 410 which generally includes top member 424, retainer 30, and receptacle 452. Top member 424 comprises an elongate panel or other rigid structure providing support surface 466. Support surface 466 is a generally flat planar surface and is preferably dimensioned so as to have a surface area sufficient for extending entirely beneath and beyond an 8½×11 inch document. Preferably, support surface 466 has a sufficient longitudinal length to extend completely beneath and beyond a A-4 size document.

Receptacle 452 comprises a container, having a floor and a plurality of sides, movably supported below support surface 466. Receptacle 452 is preferably configured to retain conventionally sized writing utensils such as pens, pencils, crayons or markers. Receptacle 452 is also preferably sized to receive other supplies such as paperclips, binder clips, tacks, erasers, and the like. In the particular embodiment illustrated, receptacle 452 is pivotally coupled to top member 424 for pivotal movement about axis 453 which extends intermediate longitudinal ends 416 and 418 of clipboard 410. In the preferred embodiment, axis 453 lies proximate to end 418 opposite retainer 30. Receptacle 452 pivots between an open position (as shown) in which opening 456 of receptacle 452 is uncovered to permit the interior of receptacle 452 to be accessed and a closed position in which opening 456 lies closely adjacent to the underside of top member 424 such that opening 456 is substantially covered. Pivotal movement of receptacle 454 from the open position to the closed position as indicated by arrow 455.

In the particular embodiment illustrated, receptacle 452 is pivotally coupled to member 424 by a conventionally known pivot pin arrangement. Alternatively, receptacle 452 may be pivotally coupled to member 424 by other conventionally known or future developed structures or mechanisms which permit relative pivotal movement of two structures such as a living hinge and the like. In yet other alternative embodiments, receptacle 452 may alternatively be configured to be slidably supported relative to member 424 so as to slide between an open position and a closed position.

CLIPBOARD 510

Figure 15:
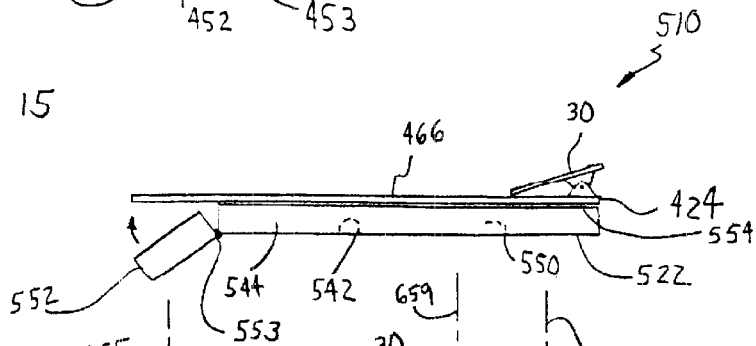
FIG. 15 is a side elevational view of a fifth alternative embodiment of the clipboard of FIG. 1.

FIG. 15 illustrates clipboard 510, a fifth alternative embodiment of clipboard 10. Clipboard 510 is substantially similar to clipboard 410 except that clipboard 510 additionally includes a bottom member 522 and includes receptacle 552 in lieu of receptacle 452. For ease of illustration, those remaining components of clipboard 510 which correspond to similar components of clipboard 410 are numbered similarly. Bottom member 522 is coupled to top member 424 beneath top member 424. Bottom member 522 generally includes a floor 542 and a plurality of side walls 544 which form a main receptacle 550. Receptacle 550 preferably has internal dimensions sufficiently sized to receive an unfolded, unaltered 8½×11 inch flat document. Receptacle 550 is preferably dimensioned so as to further be able to retain such an A-4 size document. In the particular embodiment illustrated, receptacle 550 is pivotally coupled to top member 424 along a transverse side opposite to a latching mechanism (not shown). As a result, top member 424 may be pivoted relative to bottom member 422 to bottom member 522 to enable the interior of receptacle 550 to be accessed. In alternative embodiments, bottom member 522 may be pivotally coupled to top member 424 along other axes, such as a transversely extending axis. In yet alternative embodiments, bottom member 522 may be slidably coupled to top member 424 such that bottom member 522 and top member 424 may be slidably moved relative to one another between an uncovered position in which opening 554 of receptacle 550 is uncovered and a closed position. In yet another alternative embodiment, bottom member 522 may be fixedly mounted or integrally formed as part of top member 424, wherein bottom member 522 includes an axial opening and door similar to that shown with respect to clipboard 310. In lieu of the door extending along an axial end, bottom member 522 may have a longitudinally extending opening along a side of clipboard 510 with an appropriately configured door.

Receptacle 552 is substantially identical to receptacle 452 except that receptacle 552 is pivotally coupled to bottom member 522 for pivotal movement about axis 553. Like receptacle 452, receptacle 552 pivots between an open position (as shown) and a closed position. Although not illustrated, each of clipboards 410 and 510 additionally include a latch mechanism configured for releasably retaining receptacle 452, 552 in the closed position.

CLIPBOARD 610

Figure 16:
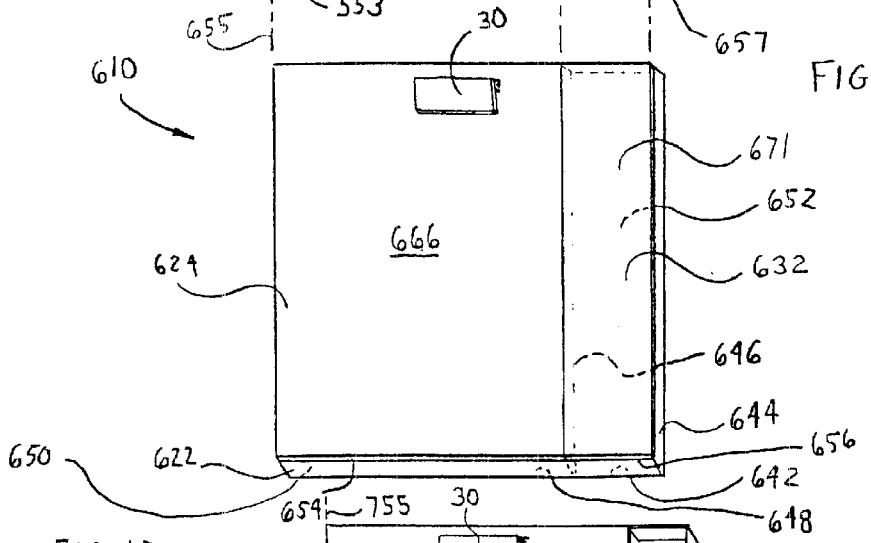
FIG. 16 is a top perspective view of a sixth alternative embodiment of the clipboard of FIG. 1.

FIG. 16 schematically illustrates clipboard 610, a sixth alternative embodiment of clipboard 10. Clipboard 610 generally includes bottom member 622, top member 624, retainer 30, and lid 632. Bottom member 622 generally includes a bottom structure providing an internal floor 642 and a plurality of side walls 644 which form a general interior basin 648. Bottom member 622 further includes a partition wall 646 which divides basin 648 into a main receptacle 650 and an auxiliary receptacle 652. Main receptacle 650 preferably has internal dimensions sized such that receptacle 650 can receive a flat, unfolded 8½×11 inch document. Receptacle 650 is preferably dimensioned so as to also receive a flat, unfolded size A-4 document. Receptacle 650 has an opening 654 which faces upwardly away from floor 642.

Receptacle 652 extends beside receptacle 650 and has an interior dimension so as to receive conventionally sized writing utensils such as pencils, pens, markers, crayons, and the like. Receptacle 652 has a major dimension extending in a longitudinal direction along the major dimension of receptacle 650. Although not illustrated, bottom member 622 may include additional dividing walls for further subdividing receptacle 652.

Top member 624 extends at least partially above receptacle 650 and provides a support surface 666 upon which articles, such as paper documents, may be retained by retainer 30. Support surface 666 preferably is a flat planar surface sufficiently rigid to form a writing surface. Surface 666 preferably has a surface area of at least 8½×11 inches and preferably a longitudinal length sufficient to also support size A-4 paper (8.27"×11.69").

Top member 624 is preferably movable relative to bottom member 622 between a closed or covered position in which top member 624 extends over and covers opening 654 of receptacle 650 and an open position or uncovered position in which opening 654 is uncovered. In the particular embodiment illustrated, top member 624 is pivotally coupled to bottom member 622 for pivotal movement about axis 655. Alternatively, top member 624 may be pivotally coupled to bottom member 622 along other axes. In yet other embodiments, top member 624 may be slidably coupled to bottom member 622 for movement between the closed and open positions. In yet another alternative embodiment, top member 624 may be permanently adhered or formed as part of bottom member 622, wherein bottom member 622 includes an axial or transverse side opening with a door or other retention mechanism.

Lid 632 generally comprises a door or other covering extending above receptacle 650. Lid 632 is movable relative to bottom member 622 between an open position in which opening 656 of receptacle 652 is uncovered and a closed position (shown). In the particular embodiment illustrated, lid 632 is pivotally coupled to bottom member 622 for pivotal movement about axis 657 between the closed and open positions. Alternatively, lid 632 may be pivotally coupled to bottom member 622 for pivotal movement about axis 659. In alternative embodiments, lid 632 may be pivotally coupled to bottom member 622 about other axes. Moreover, lid 632 may alternatively be slidably coupled to bottom member 622 for slidable movement between the open and closed positions in a transverse direction or in a longitudinal direction. Although not illustrated, clipboard 610 may additionally include latching mechanisms for releasably retaining top member 624 or lid 632 in either the closed or open positions. Because lid 632 itself has a support surface 671 which extends in substantially the same plane as support surface 666, surface 671 increases the overall surface area of clipboard 610, enabling clipboard 610 to be more compact in size and providing the required amount of surface area for supporting documents. Like clipboards 10–510, clipboard 610 enables the interior of an auxiliary receptacle to be accessed without requiring movement of a main support surface. Although lid 632 is illustrated as having sides that terminate directly at or above dividing wall 646, the width of lid 632 may alternatively be increased or decreased with a corresponding increase or decrease of the width of top member 624 such that the length and width dimensions of lid 632 do not identically correspond with the length and width dimensions of compartment 652. In general, the same variation may be made to any of the other clipboards discussed herein.

CLIPBOARD 710

Figure 17:
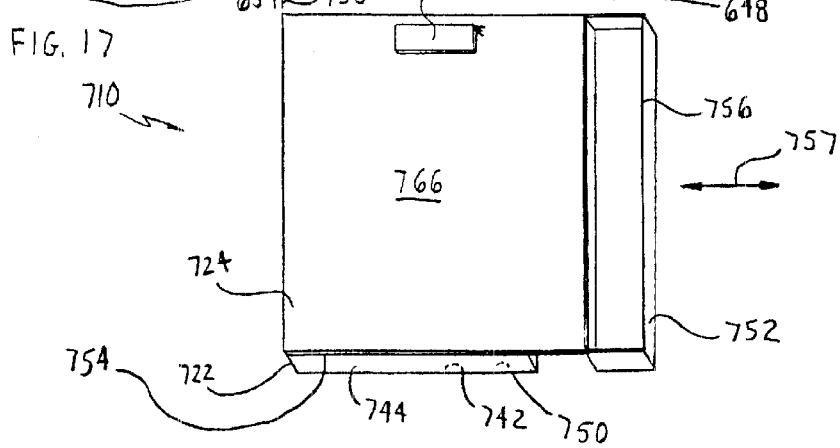
FIG. 17 is a top perspective view of a seventh alternative embodiment of the clipboard of FIG. 1.

FIG. 17 schematically illustrates clipboard 710, a seventh alternative embodiment of clipboard 10. Clipboard 710 generally includes bottom member 722, top member 724, retainer 30, and receptacle 752. Bottom member 722 generally includes a bottom structure providing an internal floor 742 and a plurality of side walls 744 which form a receptacle 750 having an opening. 754 which faces in an upward direction. Receptacle 750 preferably has internal dimensions such that receptacle 750 is configured to receive an unfolded, flat 8½×11 inch size document and preferably also in an A-4 size document. Although less desirable, receptacle 750 may be smaller.

Top member 724 extends above receptacle 750 and provides support surface 766. Support surface 766 is a generally flat planar surface having sufficient rigidity to serve as a writing surface or other surface for supporting articles held against it by retainer 30. Surface 766 preferably has a surface area of at least 8½×11 inches and preferably a length of at least 11.69", enabling surface 766 to accommodate A-4 size documents.

Top member 724 and surface 766 are preferably movable relative to bottom member 722 between a closed position in which top member 724 overlies and covers opening 754 and an open position in which opening 754 is uncovered. In the particular embodiment illustrated, top member 724 is pivotally coupled to bottom member 722 for pivotal movement about axis 755 between the open and closed positions. Alternatively, top member 724 may be pivotally coupled to bottom member 722 for pivotal movement about alternative axes. In yet other embodiments, top member 724 may be slidably supported relative to bottom member 722 for slidable movement between the open and closed positions. In yet other embodiments, top member 724 may be integrally formed as part of or fixedly secured to bottom member 722, wherein bottom member 722 includes a side or axial opening such as described with respect to clipboard 310.

Receptacle 752 comprises a small container or compartment having an opening 756. Receptacle 752 preferably has internal dimensions configured to receive conventionally sized writing utensils such as pens, markers, crayons, and the like. Receptacle 752 is movable in the direction indicated by arrows 757 between an open position (shown) in which opening 756 is uncovered and a closed position in which opening 756 is covered. In the particular embodiment illustrated, receptacle 752 slides relative to top member 724 in the direction indicated by arrows 757 between the open and closed positions. In the particular embodiment illustrated, the lower edge of top member 724 includes opposing channels or grooves which serve as tracks for receiving projections extending from receptacle 752 to facilitate such sliding movement. In such an embodiment, receptacle 752 is carried by top member 724 such that movement of top member 724 also results in movement of receptacle 752. In an alternative embodiment, clipboard 710 includes tracks or other supporting structures coupled to or formed as part of bottom member 722, wherein receptacle 752 slides along such underlying tracks or guides between the open and closed positions, allowing receptacle 752 to remain beside bottom member 722 even when top member 724 is moved relative to bottom member 722. In yet alternative embodiments, receptacle 752 may be pivotally coupled to either bottom member 722 or top member 724 so as to pivot between the open and closed positions in a fashion similar to that shown and described with respect to clipboard 510. Although not illustrated, clipboard 710 additionally includes latch mechanisms, such as catches, hooks, mechanical locking structures, zippers, and the like, for releasably retaining top member 724 or receptacle 752 in the closed or open positions. Like the other described clipboards, clipboard 710 enables the interior of an auxiliary compartment or receptacle to be accessed without requiring movement of a support surface. In each of the described embodiments, the clipboards are formed from substantially rigid materials such as plastic, aluminum, wood, or various composites. In alternative embodiments, the bottom structure and side walls forming the receptacles may alternatively be formed from a flexible material such as canvas, fabric, or flexible plastic material, wherein the top member or lid rigidities the underlying bottom structure. In particular embodiments, the lid itself may be formed from a flexible material, such as canvas, fabric, or flexible plastic, sewn or otherwise secured to the top member or an adjacent bottom member.

CONCLUSION

FIGS. 1–17 illustrate but a few preferred embodiments of a clipboard which enables the interior of an auxiliary receptacle to be accessed without requiring movement of the clipboard support surface. Although clipboards 10, 110, 210, 310, 410, 510, 610, and 710 illustrate particular combinations or variations of features which facilitate this benefit, other combinations of such features may be provided in such a clipboard.

Although the present invention has been described with reference to preferred embodiments, workers skilled in the art will recognize that changes may be made in form and detail without departing from the spirit and scope of the invention. For example, although different preferred embodiments may have been described as including one or more features providing one or more benefits, it is contemplated that the described features may be interchanged with one another or alternatively be combined with one another in the described preferred embodiments or in other alternative embodiments. Because the technology of the present invention is relatively complex, not all changes in the technology are foreseeable. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. A clipboard comprising:

a base, the base having a backside, two side walls, and two end walls defining a storage space, the base further including an internal partition dividing the storage space into first and second receptacles;

a first lid movably connected to the base and adapted to cover the first receptacle, the first lid including a top surface;

a second lid movably connected to the base at the partition, the second lid adapted to cover the second receptacle; and a clip rotatable mounted to the first lid top surface.

2. The clipboard of claim 1, wherein the first and second lids pivot between the closed position and the open position.

3. The clipboard of claim 1, wherein the base extends substantially along a plane and wherein the second lid has an outer surface oblique to the plane.

4. The clipboard of claim 1, wherein the second lid has an outer surface and wherein the outer surface extends contiguously from the first lid top surface.

5. The clipboard of claim 1, including at least one first latch configured to releasably retain the first lid in at least one of the closed position and the open position.

6. The clipboard of claim 1, wherein the base has a first major dimension extending along a first axis and a second minor dimension extending along a second axis and wherein the second receptacle extends substantially parallel to the second axis.

7. A clipboard comprising:

a first support surface;

a retainer adjacent to the first support surface, wherein the retainer is proximate a first end of the first support surface and wherein the retainer is configured to hold objects adjacent to the first support surface;

a first receptacle coupled to the first support surface, the first receptacle having a first opening, wherein the first receptacle is proximate a second opposite end of the first support surface, and a lid movable between a closed position in which the first lid is covered and an open position in which the first opening is uncovered, wherein the lid is configured to move between the closed position and the open position while the support surface remains stationary.

8. The clipboard of claim 7, wherein the first receptacle is oriented parallel to the second axis and beside the first support surface.

9. The clipboard of claim 8, wherein the first receptacle extends below the first support surface.

10. The clipboard of claim 7, including a second receptacle having a second opening.

11. The clipboard of claim 7, including a second receptacle having a second opening and extending at least partially beneath the first support surface.

12. The clipboard of claim 11, wherein the second receptacle has internal dimensions of at least about 8.5 inches by 11.0 inches.

13. The clipboard of claim 11, wherein the first support surface pivots relative to the second receptacle.

14. The clipboard of claim 13, wherein the lid pivots about a first axis between the closed position and the open position and wherein the first support surface pivots about a second axis.

15. The clipboard of claim 14, wherein the first axis and the second axis are perpendicular to one another.

16. The clipboard of claim 13, wherein the second receptacle has a first major dimension extending along a first axis parallel to the first support surface and a second minor dimension extending along a second axis parallel to the first support surface, and wherein the first support surface and the second receptacle are pivotally coupled to one another for pivotal movement about a third axis parallel to the first axis.

17. The clipboard of claim 11, wherein at least one of the first support surface and the second receptacle are movable relative to one another between an uncovered position in which the second opening is uncovered and a covered position in which the second opening is uncovered.

18. The clipboard of claim 17, including at least one latch configured to releasably retain the first support surface and the second support surface in the covered position.

19. The clipboard of claim 7, wherein the first support surface is substantially planar and smooth.

20. The clipboard of claim 7, wherein the retainer comprises a clip.

21. The clipboard of claim 7, wherein the first receptacle is configured to receive writing utensils.

22. The clipboard of claim 7, wherein the first receptacle includes a plurality of compartments.

23. A clipboard comprising:

a first support surface;

a member having a first side providing the first support surface and a second opposite side;

at least one pocket carried by the member on the second side a retainer adjacent to the first support surface, wherein the retainer is configured to hold objects adjacent to the first surface;

a first receptacle coupled to the first support surface, the first receptacle having a first opening; and a lid movable between a closed position in which the first lid is covered and an open position in which the first opening is uncovered, wherein the lid is configured to move between the closed position and the open position while the support surface remains stationary.

24. The clipboard of claim 23, including:

a second receptacle extending at least partially beneath the first support surface; and a clam-shell shaped member providing the first support surface.

25. The clipboard of claim 23, wherein the lid slides between the closed position and the open position.

26. The clipboard of claim 23, wherein the first support surface extends substantially along a plane and wherein the lid has an outer surface extending in the plane.

27. The clipboard of claim 23, including a second receptacle having a second opening and extending at least partially beneath the first support surface, wherein the first support surface pivots relative to the second receptacle about a first axis and wherein the lid pivots about a second axis parallel to the first axis.

28. The clipboard of claim 23, including:

a second receptacle having a second opening; and a top member providing the first support surface and extending at least partially above the second receptacle, wherein the top member is movable between an uncovered position in which the second opening is uncovered and a covered position in which the second opening is covered and wherein the lid is coupled to the top member so as to move with the top member when the top member is moved between the covered and uncovered positions.

29. The clipboard of claim 23, including a second receptacle having a second opening and extending at least partially beneath the first support surface, wherein the first opening faces in a first direction and wherein the second opening faces in a second direction perpendicular to the first direction.

30. The clipboard of claim 23, a including:

a top member providing the first support surface; and a hinge mechanism pivotally coupling the lid to the top member, wherein the hinge mechanism includes a tail having a rigid proximal portion coupled to the lid, a distal portion slidably captured within a channel formed within the top member and an intermediate flexible member providing a living hinge for pivotal movement of the lid between the closed position and the open position.

31. A clipboard having a major dimension terminating at first and second ends and a minor dimension terminating at first and second sides, clipboard comprising:

a first support surface;

a retainer adjacent the first end wherein the retainer is configured to hold objects adjacent to the first support surface; and a first receptacle adjacent to the second end pivotally supported for pivotal movement about a first pivot axis extending intermediate at least one of the first and second sides and the first and second ends.

32. The clipboard of claim 31, including a second compartment having internal dimensions of at least about 8.5 inches by 11.0 inches, and wherein the first support surface is pivotable relative to the second compartment about a second axis parallel to the major dimension.

33. The clipboard of claim 32, wherein the second axis extends perpendicular to the first axis.

34. A clipboard comprising:

a first receptacle having internal dimensions of at least about 8.5 inches by 11.0 inches and defining a first opening;

a second receptacle beside the first receptacle having a second opening;

a first cover proximate the first receptacle and having a major dimension and a minor dimension, the first cover pivotable relative to the first receptacle about a first axis parallel to the major dimension; and a second cover proximate and pivotable relative to the second receptacle, wherein at least one of the first cover and the second cover include a substantially planar support surface, wherein at least one of the first cover and the first receptacle are configured to move relative to one another between a first opening covered position and a first opening closed position, and wherein at least one of the second cover and the second receptacle are configured to move relative to one another between a second opening covered position and a second opening closed position.

35. The clipboard of claim 34, wherein the first opening and the second opening face in a common direction.

36. The clipboard of claim 34, wherein the first cover provides the first substantially planar support surface, wherein the second cover provides a second substantially planar support surface and wherein the first planar support surface and the second planar support surface extend in a common plane when the first cover and the first receptacle are in the first opening closed position and when the second cover and the second receptacle are in the second opening closed position.

37. A clipboard having a major dimension extending along a first major axis and a minor dimension extending along a second minor axis, clipboard comprising:

a top member providing a first support surface;

a retainer adjacent to the first support surface, wherein the retainer is configured to hold objects adjacent to the first support surface; and a receptacle slidably supported relative to the first support surface for movement in a direction parallel to the second minor axis between a covered position in which the first receptacle extends below the first support surface and an uncovered position.

38. The clipboard of claim 37, including a second receptacle coupled to the top member.

* * * * *

UNITED STATES PATENT AND TRADEMARK OFFICE

CERTIFICATE OF CORRECTION

PATENT NO. : 6,637,774 B2
DATED : October 28, 2003
INVENTOR(S) : Gilius A. Gaska It is certified that error appears in the above-identified patent and that said Letters Patent is hereby corrected as shown below:

Column 16,
Line 52, please delete "first support surface," and insert -- first support surface; --.

Column 18,
Line 32, please delete "the first end" and insert -- the first end, --.

Column 20,
Line 11, please delete "claim 37," and insert -- claim 37 --.

Signed and Sealed this

Third Day of February, 2004

JON W. DUDAS
*Acting Director of the United States Patent and Trademark Office*